US006560939B2

(12) United States Patent
Sorkin

(10) Patent No.: US 6,560,939 B2
(45) Date of Patent: May 13, 2003

(54) INTERMEDIATE ANCHOR AND INTERMEDIATE ANCHORAGE SYSTEM FOR A POST-TENSION SYSTEM

(76) Inventor: Felix L. Sorkin, 13022 trinity Dr., Stafford, TX (US) 77477

( * ) Notice: Subject to any disclaimer, the term of this patent is extended or adjusted under 35 U.S.C. 154(b) by 31 days.

(21) Appl. No.: 09/810,272

(22) Filed: Mar. 19, 2001

(65) Prior Publication Data

US 2002/0129570 A1 Sep. 19, 2002

(51) Int. Cl.[7] ..... E04C 5/12; E04C 5/08

(52) U.S. Cl. ..... 52/223.13; 52/223.6; 52/742.14; 24/122.6

(58) Field of Search ..... 52/223.6, 223.7, 52/223.13, 223.14, 742.14; 174/91, 92; 24/459, 464, 122.6; 403/374.1, 368, 369

(56) References Cited

U.S. PATENT DOCUMENTS

| | | | | | |
|---|---|---|---|---|---|
| 4,023,242 | A | * | 5/1977 | Caro Roqueta | 24/115 M |
| 4,192,114 | A | * | 3/1980 | Jungwirth et al. | 52/223.13 |
| 4,640,068 | A | * | 2/1987 | Jungwirth et al. | 24/122.6 |
| 4,821,474 | A | * | 4/1989 | Rodriguez | 24/122.6 |
| 4,918,887 | A | * | 4/1990 | Davis et al. | 52/223.13 |
| 5,347,777 | A | * | 9/1994 | Sudduth | 52/223.13 |
| 5,749,185 | A | | 5/1998 | Sorkin | |
| 5,755,065 | A | * | 5/1998 | Sorkin | 52/223.13 |
| 5,839,235 | A | * | 11/1998 | Sorkin | 24/122.6 |
| 6,023,894 | A | * | 2/2000 | Sorkin | 24/122.6 |
| 6,027,278 | A | * | 2/2000 | Sorkin | 403/371 |
| 6,098,356 | A | | 8/2000 | Sorkin | |

FOREIGN PATENT DOCUMENTS

| | | | | |
|---|---|---|---|---|
| DE | 2911437 A | * | 10/1980 | 52/223.13 |
| DE | 3440220 A | * | 5/1986 | 52/223.13 |
| DE | 3801451 A | * | 8/1989 | 52/223.13 |
| FR | 2311152 A | * | 12/1976 | 52/223.13 |
| FR | 2492870 A | * | 4/1982 | 52/223.13 |
| GB | 2155973 A | * | 10/1985 | 52/223.13 |
| JP | 401284674 A | * | 11/1989 | 52/223.14 |

* cited by examiner

*Primary Examiner*—Carl D. Friedman
*Assistant Examiner*—Brian E. Glessner
(74) *Attorney, Agent, or Firm*—Harrison & Egbert

(57) ABSTRACT

An anchor for an intermediate anchorage system including an anchor body having a first wedge-receiving cavity and a second wedge-receiving cavity. The first wedge-receiving cavity has tapered walls narrowing in diameter from the first side to the second side of the anchor body. The second wedge-receiving cavity has tapered walls narrowing in diameter from the second side to the first side of the anchor body. A polymeric encapsulation extends around the anchor body in liquid-tight sealing relationship therewith. A tendon is affixed within one of the first and second wedge-receiving cavities and extends outwardly from the anchor body.

11 Claims, 3 Drawing Sheets

INTERMEDIATE ANCHOR AND INTERMEDIATE ANCHORAGE SYSTEM FOR A POST-TENSION SYSTEM

BACKGROUND OF THE INVENTION

1. Field of the Invention

The present invention relates to post-tensioning systems. More particularly, the present invention relates to post-tensioning systems having intermediate anchorages. Furthermore, the present invention relates to sealing devices for preventing liquid intrusion into the exposed sections of tendon in the post-tension system.

2. Description of Related Art

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

There are many post-tension systems employing intermediate anchorages where the length of the slab is too long to tension with a single anchor. In these systems, the intermediate anchor is interposed between a live end and a dead end anchor. In the construction of such intermediate anchorage systems, the tendon extends for a desired length to the intermediate anchor. A portion of the sheathing is removed in the vicinity of the intermediate anchor. The intermediate anchor is installed onto a form board in accordance with conventional practice. The unsheathed portion of the tendon is received by a tensioning apparatus such that the tendon is stressed in the area between the dead end anchor and the intermediate anchor. After stressing the tendon, concrete is poured over the exterior of the sheathed tendon and over the dead end anchor and intermediate anchor. The remaining portion of the tendon extends from the intermediate anchor to either another intermediate anchorage or to the live end anchor. Intermediate anchorage systems are employed whenever the slab is so long that a single live anchor extending to a single dead end anchor is inadequate. For example, two intermediate anchorages would be used for slabs having a length of approximately 300 feet.

A problem that affects many of the intermediate anchorage systems is the inability to effectively prevent liquid intrusion into the unsheathed portion of the tendon. Normally, the unsheathed portion will extend outwardly, for a distance, from the intermediate anchor in the direction toward the dead end anchor. Additionally, another unsheathed portion will extend outwardly at the intermediate anchor toward the live end anchor. In normal practice with a single live anchor and without intermediate anchors, a liquid-tight tubular member is placed onto an end of the anchor so as to cover the unsheathed portion of the tendon. This is relatively easy to accomplish since the length of the tendon is minimal at the live end. However, it is a considerable burden to attempt to slide such a tubular member along the entire length of the tendon so as to form the liquid-tight seal at the intermediate anchorage. In normal practice, tape, or other corrosion protection materials, are applied to the exposed portion of the tendon adjacent the intermediate anchorage. Extensive practice with this technique has shown that it is generally ineffective for preventing liquid intrusion into the interior of the tendon or into the interior of the intermediate anchorage. As such, a great need has developed in which to protect the exposed areas of the tendon adjacent the intermediate anchorage.

It is an object of the present invention to provide an intermediate anchorage for a post-tension system which facilitates the ability to install the intermediate anchorage system.

It is another object of the present invention to provide an intermediate anchorage for a post-tension system which effectively prevents liquid intrusion into the intermediate anchorage area.

It is another object of the present invention to provide an intermediate anchorage system which avoids the need to thread the intermediate anchor along the great lengths of tendon.

It is a further object of the present invention to provide an intermediate anchorage system for a post-tension system which is easy to install using existing installation techniques.

It is a further object of the present invention to provide an intermediate anchorage for a post-tension system which is easy to use, relatively inexpensive, and simple to manufacture.

These and other objects and advantages of the present invention will become apparent from a reading of the attached specification and appended claims.

SUMMARY OF THE INVENTION

The present invention is an anchor for an intermediate anchorage system comprising an anchor body having a first wedge-receiving cavity and a second wedge-receiving cavity. The first wedge-receiving cavity has tapered walls narrowing in diameter from a first side to a second side of the anchor body. The second wedge-receiving cavity has tapered walls narrowing in diameter from the second side to the first side of the anchor body. The polymeric encapsulation is in liquid-tight sealing relationship with an exterior surface of the anchor body. The polymeric encapsulation defines a first tubular portion extending outwardly from the first wedge-receiving cavity and axially aligned therewith. The first tubular portion extends outwardly from the second side of the anchor body. The polymeric encapsulation defines a second tubular portion extending outwardly from the second wedge-receiving cavity and axially aligned therewith. The second tubular portion extends outwardly from the first side of the anchor body. The polymeric encapsulation defines a first cap-receiving receptacle extending outwardly of the first wedge-receiving cavity from the first side of the anchor body. The polymeric encapsulation defines a second cap-receiving receptacle extending outwardly of the second wedge-receiving cavity from the second side of the anchor body. A first cap is removably affixed in liquid-tight sealing relationship with the first cap-receiving receptacle. A second cap is removably affixed in liquid-tight sealing relationship with the second cap-receiving receptacle. The first and second caps are formed of a polymeric material.

The present invention is also an intermediate anchorage system for a post-tension system comprising an anchor body having a first cavity and a second cavity in which the first cavity narrows in diameter from a first side to a second side of the anchor body and the second cavity narrows in diameter from the second side to the first side of the anchor body. A first tendon is received within the first wedge-receiving cavity. A first plurality of wedges are received in interference-fit relationship between the first tendon and a wall of the first cavity. The first tendon has an end extending outwardly beyond the second side of the anchor body. A polymeric encapsulation is in liquid-tight sealing relationship with an exterior surface of the anchor body. The first tendon extends outwardly of this polymeric encapsulation. The polymeric encapsulation defines a first tubular portion extending outwardly from the first wedge-receiving cavity and is axially aligned therewith. The first tendon extends through the first tubular portion. The tendon has a sheathed portion and an unsheathed portion. The first plurality of wedges are in interference-fit relationship with the unsheathed portion of the tendon. The first tubular portion is in liquid-tight sealing relationship with the sheathed portion of the tendon. The polymeric encapsulation also defines a first cap-receiving receptacle extending outwardly from the first cavity on the first side of the anchor body. A first cap is removably affixed to the first cap-receiving receptacle. The tendon has an end positioned interior of the first cap.

In this intermediate anchorage system, a second tendon is received within the second cavity. A second plurality of wedges are received in interference-fit relationship between the second tendon and a wall of the second cavity. The second tendon extends outwardly beyond the first side of the anchor body. The polymeric encapsulation also defines a second tubular portion extending outwardly from the second cavity and axially aligned therewith. The second tendon extends through this second tubular portion. The polymeric encapsulation further defines a second cap-receiving receptacle extending outwardly from the second cavity from the second side of the anchor body. A second cap is removably affixed to the second cap-receiving receptacle. The tendon has an end positioned interior of this second cap.

The present invention is also a method of post-tensioning an intermediate anchorage in a post-tension system comprising the steps of: (1) forming a dead-end anchorage having a first tendon affixed thereto; (2) forming an anchor body having a first cavity and a second cavity which narrow in opposite directions; (3) affixing an end of a second tendon within the second cavity such that the second tendon extends outwardly from a first side of the anchor body; (4) positioning the dead-end anchorage and the anchor body within a form; (5) installing an end of the first tendon within the first cavity of the anchor body; (6) solidifying concrete around the dead-end anchorage and the anchor body within the form; (7) tensioning the first tendon from the first side of the anchor body; and (8) affixing the first tendon in a tensioned state within the first cavity.

The method of the present invention also includes positioning a live-end anchorage within another portion of the form. The live-end anchorage has a cavity formed therein. The second tendon is extended through this form so that the end of the second tendon is received within the cavity of the live-end anchorage. Concrete is solidified around the second tendon and the live-end anchorage. The end of the second tendon is tensioned from the live-end anchorage. The second tendon is then affixed in a tensioned state within the cavity of the live-end anchorage.

DETAILED DESCRIPTION OF THE INVENTION

Figure 1:
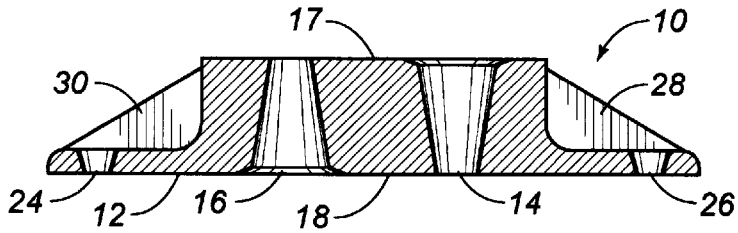
FIG. 1 is a cross-sectional view of a simple form of the anchor body of the present invention.

FIG. 1 shows an anchor 10 in accordance with a simple form of the present invention. The anchor 10 includes an anchor body 12 having a first wedge-receiving cavity 14 and a second wedge-receiving cavity 16. The anchor body 12 has a first side 17 and a second side 18. The first wedge-receiving cavity has a wall which narrows in diameter from the first side 17 to the second side 18. The second wedge-receiving cavity 16 has a wall which narrows in diameter from the second side 18 to the first side 17. Nail holes 24 and 26 are formed in flanged portions of the anchor body 12. Gussets 28 and 30 extend from the flanged portions 24 and 26 to the area of the anchor body having the wedge-receiving cavities 14 and 16.

Figure 2:
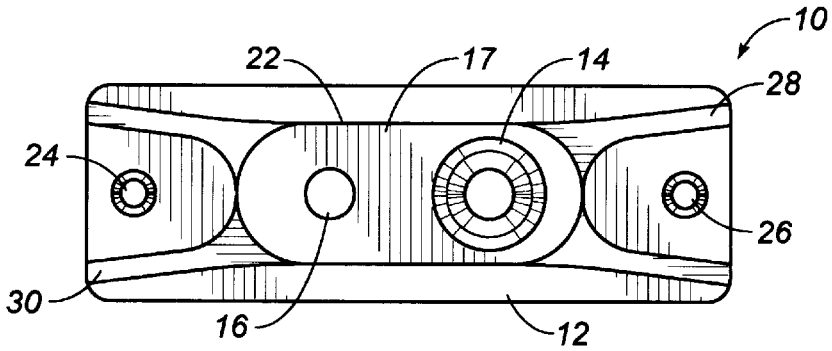
FIG. 2 is a plan view of the simple form of the anchor body of the present invention.

FIG. 2 shows the anchor 10 as having a generally rectangular configuration. The anchor 10 includes anchor body 12 having first wedge-receiving cavity 14 and second wedge-receiving cavity 16. The first side 17 is illustrated, particularly, in FIG. 2. As can be seen, the first wedge-receiving cavity 14 narrows in diameter from the first side 17 toward the second side 18. The second wedge-receiving cavity 16 is shown with its narrow diameter portion emerging on the first side 17. The arrangements of the nail holes 24 and 26 and the shape of the gussets 28 and 30 are shown in FIG. 2. The nail holes 24 and 26 are suitable for nailing the anchor body 12 to a suitable form board.

Figure 3:
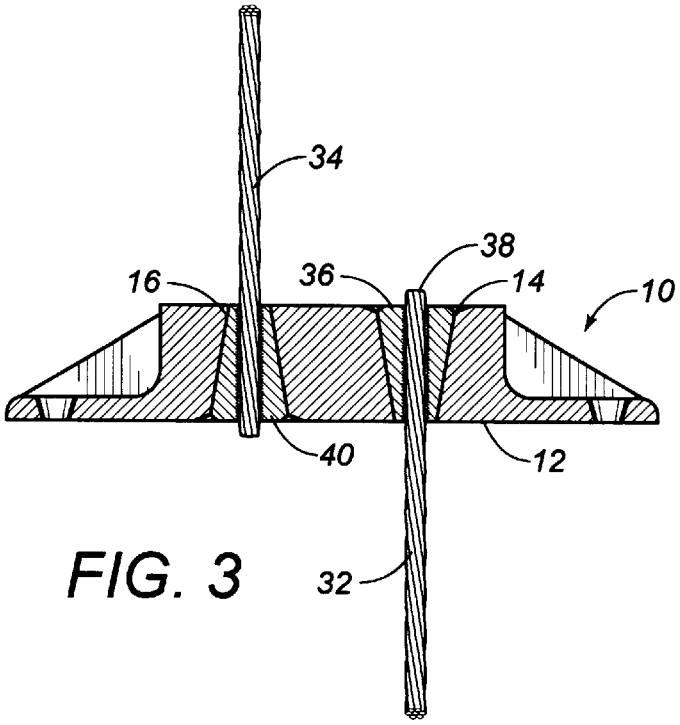
FIG. 3 is a cross-sectional view showing this simplified form of the present invention in which tendons are received therein.

FIG. 3 shows the manner in which the anchor 10 functions as an intermediate anchorage system. In particular, the anchor body 12 has a first tendon 32 affixed within the first wedge-receiving cavity 14 and a second tendon 34 affixed within the second wedge-receiving cavity 16. Wedges 36 are used so as to affix the first tendon 32 within the first wedge-receiving cavity 14. The end 38 is suitably tensioned. The wedges 36 are positioned within the cavity 14 around the exterior surface of the tendon 32. When the tendon 38 is released from its tensioned position, the retraction of the tendon 32 will urge the wedges 36 into interference-fit relationship within the first wedge-receiving cavity 14.

Within the concept of the present invention, it is important to note that the second wedge-receiving cavity 16 will act as a "dead-end" anchor. The second tendon 34 is installed within the second wedge-receiving cavity 16 prior to installation as part of the post-tension system. The second tendon 34 can be installed within the cavity 16 at the factory or at the work site. The wedges 40 can be positioned in interference-fit relationship between the walls of the second wedge-receiving cavity 16 and the exterior surface of the tendon 34 by conventional dead-end anchorage forming processes or by the process described in another patent application by the present inventor, identified as U.S. patent application Ser. No. 09/655,972, filed on Sep. 5, 2000, and entitled "Apparatus For Forming a Dead End Anchorage of a Post Tension System", presently pending.

The simplified embodiment of the present invention, as illustrated in FIGS. 1–3, shows an unencapsulated system. In other words, the system shown in FIG. 3 is for applications where corrosion resistance and protection against the elements is not desired. The present invention can be used as an intermediate anchorage without the need to thread the anchor body 12 along the long length of the tendon 32. As was stated herein previously, intermediate anchorage systems can be applied along the lengths of tendons extending for up to five hundred feet. At each location that the anchor 10 must be installed, it would be otherwise necessary to thread the anchor body 12 along the entire length of the tendon 32 until the anchor body 12 resides in its proper position adjacent to a form board. In the present invention, the anchor body 12 can simply be installed onto the end 38 of the tendon 32 prior to tensioning. Since the tendon 34 and its associated wedge-receiving cavity 16, along with the wedges 40, act as a "dead-end anchorage", the tendon 34 will be preinstalled and extend outwardly therefrom.

Figure 4:
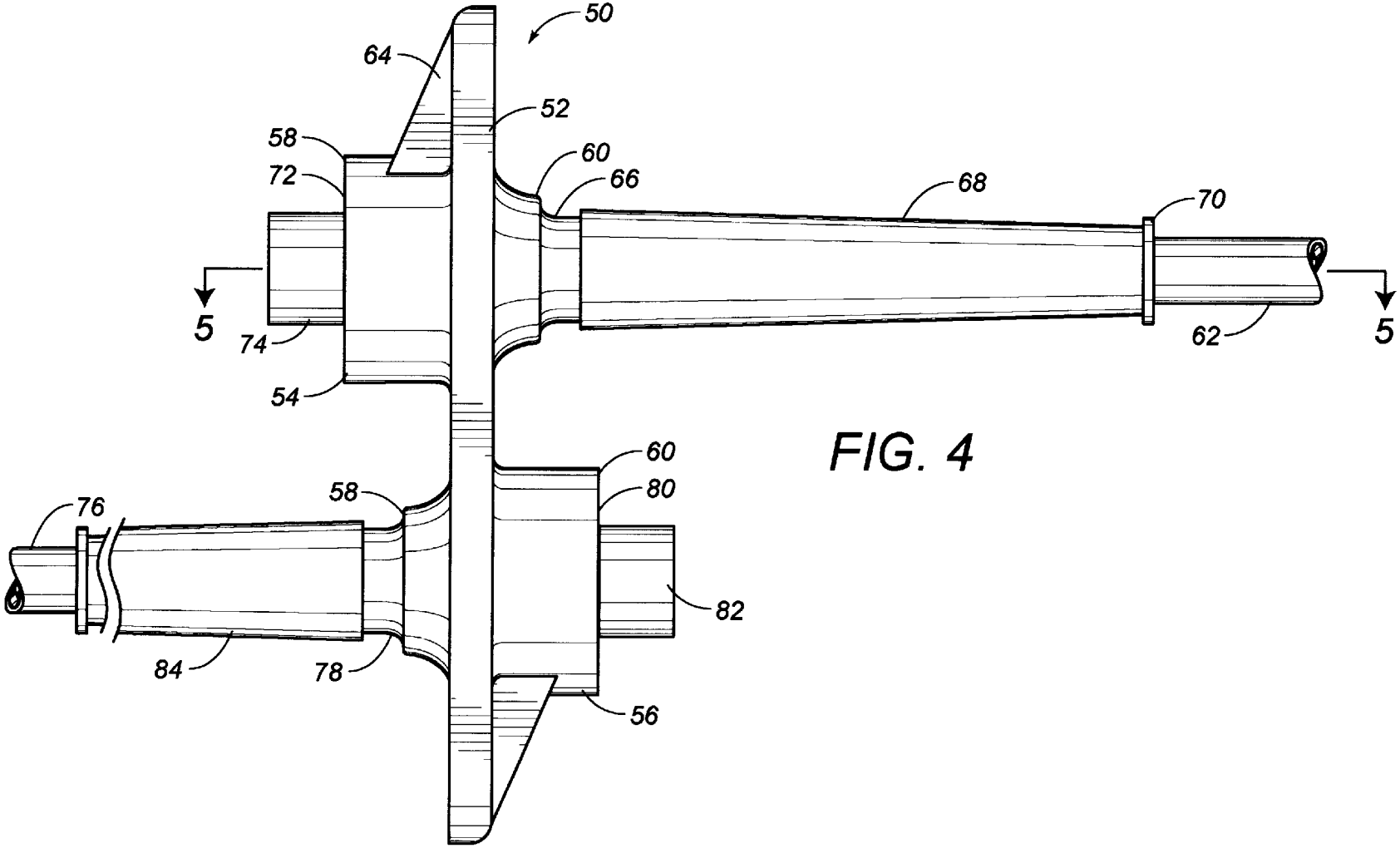
FIG. 4 is a plan view showing the preferred embodiment of the present invention.

FIG. 4 shows the preferred embodiment of the present invention in which the respective tendons are suitably encapsulated within properly encapsulated anchorages. As can be seen in FIG. 4, the intermediate anchorage system 50 includes an anchor body 52 having a first wedge-receiving cavity 54 and a second wedge-receiving cavity 56. The first wedge-receiving cavity 54 narrows in diameter from a first side 58 toward a second side 60 of the anchor body. The second wedge-receiving cavity 56 will narrow in diameter from the second side 60 to the first side 58 of the anchor body 52. A first tendon 62 is received within the first wedge-receiving cavity 54. As was described in the previous embodiment of the present invention, a first plurality of wedges will be received in interference-fit relationship between the first tendon and a wall of the first wedge-receiving cavity 54. As can be seen, the first tendon 62 has an end extending outwardly beyond the second side 60 of the anchor body 52. A polymeric encapsulation 64 is in liquid-tight sealing relationship with an exterior surface of the anchor body 52. The polymeric encapsulation 64 can be applied to the steel anchor body 52 through an injection molding process. The strong compressive forces used for the injection molding process assure a liquid-tight sealing relationship between the surfaces of the polymeric encapsulation and the surfaces of the anchor body 52. The first tendon 62 is shown as extending outwardly of the polymeric encapsulation. The polymeric encapsulation 64 will define a first tubular portion 66 extending outwardly from the first wedge-receiving cavity 58 and axially aligned therewith. The first tendon 62 will extend through this first tubular portion 66. A tubular sealing member 68 is applied to the tubular portion 66 and extends outwardly therefrom. A seal 70 is affixed within the opposite end of the tubular sealing member 68 from the tubular portion 66 so as to establish a liquid-tight sealing relationship with the first tendon 62. Various techniques can be used so as to establish a liquid-tight seal between the tendon 62 and the interior of the anchor body 52. The use of such a tubular member 68 is but one of many techniques that can be used so as to establish a proper liquid-tight seal. It is important to note that since the first wedge-receiving cavity 58 is applied directly onto the end of the tendon 62, it is not necessary to thread the tubular sealing member 68 for a great distance along the length of the tendon 62. It can be applied directly onto the end of the tendon 62 and pushed a small distance to a desired position.

The polymeric encapsulation 64 also defines a first cap-receiving receptacle 72 extending outwardly from the first wedge-receiving cavity 54 from the first side 58 of the anchor body. A first cap 74 is removably affixed to the first cap-receiving receptacle 72. The tendon 62 will have an exposed end positioned interior of this first cap 74. The first cap 74 can be secured within the first cap-receiving receptacle 72 by snap fitting or threading. A suitable grout or corrosion resistant liquid can fill the interior of the cap 74 so as to further prevent liquid intrusion into the interior area of the anchor body 52.

In FIG. 4, it can be seen that a second tendon 76 is received within the second wedge-receiving cavity 56. As stated in conjunction with the simplified form of the present invention, a second plurality of wedges are received in interference-fit relationship between an end of the second tendon 76 and a wall of the second wedge-receiving cavity 56. The second tendon 76 extends outwardly beyond the first side 58 of the anchor body 52. The polymeric encapsulation defines a second tubular portion 78 extending outwardly from the second wedge-receiving cavity 56. The second tendon 76 will extend through this second tubular portion 78. The polymeric encapsulation also defines a second cap-receiving receptacle 80 extending outwardly from the second wedge-receiving cavity 56 from the second side 60 of the anchor body 52. A second cap 82 is removably affixed to the second cap-receiving receptacle 80. The tendon 76 will have an exposed end positioned within an interior of the second cap 82. A tubular member 84 is positioned over the tubular portion 78 and extends along a certain portion of the length of the second tendon 76. A suitable seal can be placed adjacent the far end of the tubular member 84 in a similar manner that the seal 70 is positioned onto the tendon 62. This will prevent liquid intrusion along the tendon 76 into the interior of the anchor body 52.

In the embodiment shown in FIG. 4, liquid intrusion is prevented since all of the exposed portions of the tendon are in a sealed environment. As a result, the present invention can establish a proper intermediate anchorage without the risk of liquid intrusion and the problems associated therewith. The present invention facilitates installation by simply placing the anchor body 52 at the ends of the respective tendons. The second tendon 76 can be installed into the anchor body 52 prior to installation at the work site.

Figure 5:
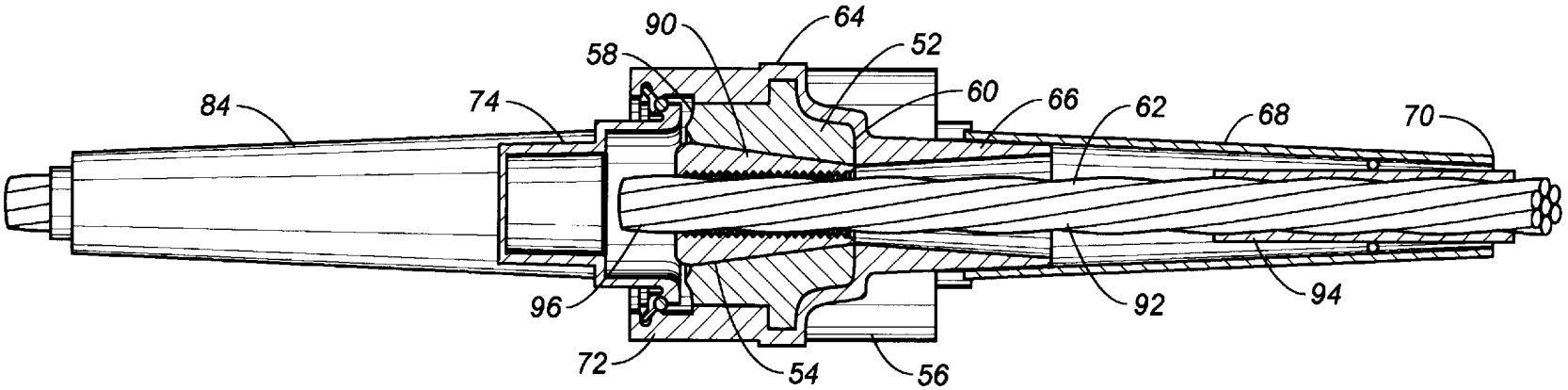
FIG. 5 is a cross-sectional view taken across lines 5—5 of FIG. 4.

FIG. 5 shows a cross-sectional view of the apparatus shown in FIG. 4. In particular, FIG. 5 shows the anchor body 52 as having polymeric encapsulation 64 extending therearound. The polymeric encapsulation 64 will define the tubular portion 66 extending outwardly from an end thereof. The anchor body 52 is illustrated as having its wedge-receiving cavity 54 formed therein. A plurality of wedges 90 are positioned in interference-fit relationship between an exterior surface of the tendon 62 and the wall of the first wedge-receiving cavity 54. The first wedge-receiving cavity 54 has a wide end at the first end 58 of the anchor body 52 and a narrow end at the opposite end 60 of the anchor body 52. The wedges 90 are positioned in interference-fit relationship between the unsheathed portion 92 of the tendon 62 and the wall of the cavity 54.

FIG. 5 shows that the tubular member 68 is affixed in liquid-tight relationship over the exterior surface of the tubular portion 66. The tubular member 68 has an end 70 in liquid-tight relationship with the sheathed portion 94 of the tendon 62.

In FIG. 5, it can be seen that the polymeric encapsulation 64 defines the first cap-receiving receptacle 72. The cap 74 is affixed within the cap-receiving receptacle 72. The end 96 of the tendon 62 is positioned within the cap 74. The sealing relationship between the cap 74 and the cap-receiving receptacle 72 will prevent liquid intrusion from adversely affecting the exposed portions of the tendon 62. The tubular member 84, as shown in FIG. 4, is illustrated in FIG. 5 as extending outwardly from the second wedge-receiving cavity 56. The second wedge-receiving cavity 56 will have a similar configuration to that of the first wedge-receiving cavity 54.

Figure 6:
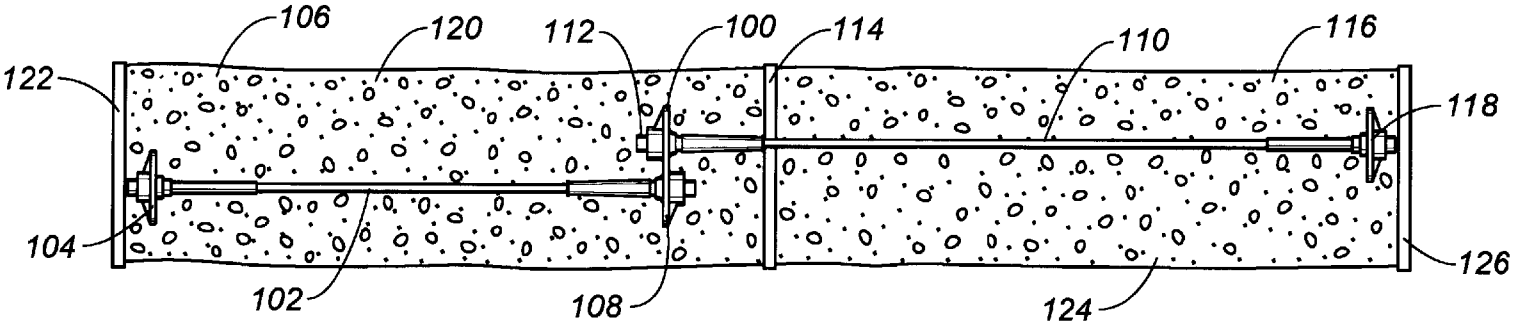
FIG. 6 is a diagrammatic illustration of the method of the present invention for forming an intermediate anchorage of a post-tension system.

FIG. 6 shows the method of forming an intermediate anchorage in accordance with the teachings of the present invention. The intermediate anchorage 100 is illustrated particularly in FIG. 6.

In the method of the present invention, one end of the tendon 102 is affixed within a dead-end anchorage 104 within a portion 106 of a form. The end of the tendon 102 is installed within the dead-end anchorage 104 prior to installation within the form portion 106. The dead-end anchorage 104 is placed into the form portion 106 before concrete is poured therein. The tendon 102 is extended through the form portion 106 and inserted into the first wedge-receiving receptacle 108 associated with the intermediate anchorage 100. A second tendon 110 has its end affixed previously within the second tendon-receiving receptacle 112 associated with the intermediate anchorage 100. Since the second tendon-receiving receptacle 112 acts as a "dead-end anchorage", the installation of the end of tendon 110 can occur at the factory or at the work site prior to installation into the form portion 106. The tendon 110 can then be extended through the form board 114 and through the interior of another form portion 116. The opposite end of the tendon 110 is illustrated as received within a live-end anchorage 118.

Initially, concrete 120 is poured into the area between the form board 114 and the form board 122. The concrete 120 will surround the dead-end anchorage 104 and the intermediate anchorage 110. The tendon 102 will extend through the concrete 120 within the form portion 106. After the concrete 120 is solidified, the form board 114 can be suitably removed so as to expose the live-end of the tendon 102 extending outwardly of the first tendon-receiving receptacle 108. Suitable tensioning equipment can be applied to this end of the tendon 102 so as to suitably tension the tendon 102 and establish the post-tension characteristics of the concrete 120 within form portion 106. After tensioning, the tendon is released and secured by suitable wedges within the wedge-receiving cavity 108 of intermediate anchorage 100.

The tendon 110 is extended through the form portion 116 so as to be received by a cavity within the live-end anchorage 118. Concrete 124 is then poured into the form portion 116 between the end of the intermediate anchorage 100 and the form board 126. After the concrete 124 has solidified, the form board 126 can be removed so as to expose the live-end of the tendon 118 extending outwardly of the cavity of the live-end anchorage 118. Suitable tensioning equipment can then be applied to this live-end of the tendon 110 so as to tension the tendon 110. Wedges can be installed within the cavity of the live-end anchor 118 so as to establish a strong and secure joinder of the end of the tendon 110 with the cavity of the anchor 118.

As can be seen in FIG. 6, the present invention establishes an intermediate anchorage without the need for extended lengths of the tendon. Conventional lengths of tendons can be used. Each intermediate anchorage will have the tendon installed, as a dead-end anchor, at the factory and then shipped with its attached tendon to the work site. The intermediate anchorage 100 can be easily sealed since it is installed at the ends of the respective tendons. The present invention fully functions as an intermediate anchorage without extended lengths of tendons.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An anchor for an intermediate anchorage system comprising:

a anchor body having a first wedge-receiving cavity and a second wedge-receiving cavity, said anchor body having a first side and a second side, said first wedge-receiving cavity having tapered walls narrowing in diameter from said first side to said second side, said second wedge-receiving cavity having tapered walls narrowing in diameter from said second side to said first side;

a polymeric encapsulation in liquid-tight sealing relationship with an exterior surface of said anchor body, said polymeric encapsulation defining a first cap-receiving receptacle extending outwardly of said first wedge-receiving cavity from said first side of said anchor body, said polymeric encapsulation defining a second cap-receiving receptacle extending outwardly of said second wedge-receiving cavity from said second side of said anchor body;

a first cap removably affixed in liquid-tight sealing relationship with said first cap-receiving receptacle; and a second cap removably affixed in liquid-tight sealing relationship with said second cap-receiving receptacle.

2. The anchor of claim 1, said polymeric encapsulation defining a first tubular portion extending outwardly from said first wedge-receiving cavity and axially aligned therewith, said first tubular portion extending outwardly from said second side of said anchor body.

3. The anchor of claim 2, said polymeric encapsulation defining a second tubular portion extending outwardly from said second wedge-receiving cavity and axially aligned therewith, said second tubular portion extending outwardly from said first side of said anchor body.

4. The anchor of claim 1, said first and second caps being formed of a polymeric material.

5. An intermediate anchorage system for a post-tension system comprising:

an anchor body having a first wedge-receiving cavity and a second wedge-receiving cavity, said first wedge-receiving cavity narrowing in diameter from a first side to a second side of said anchor body, said second wedge-receiving cavity narrowing in diameter from said second side to said first side of said anchor body;

a first tendon received within said first wedge-receiving cavity;

a first plurality of wedges received in interference-fit relationship between said first tendon and a wall of said first wedge-receiving cavity, said first tendon having an end extending outwardly beyond said second side of said anchor body;

a polymeric encapsulation in liquid-tight sealing relationship with an exterior surface of said anchor body, said first tendon extending outwardly of said polymeric encapsulation, said polymeric encapsulation defining a first tubular portion extending outwardly from said first wedge-receiving cavity and axially aligned therewith, said first tendon extending through said first tubular portion;

a second tendon received within said second wedge-receiving cavity; and a second plurality of wedges received in interference-fit relationship between said second tendon and a wall of said second wedge-receiving cavity, said second tendon extending outwardly beyond said first side of said anchor body, said polymeric encapsulation defining a second tubular portion extending outwardly from said second wedge-receiving cavity and axially aligned therewith, said second tendon extending through said second tubular portion.

6. The system of claim 5, said polymeric encapsulation defining a first cap-receiving receptacle extending outwardly from said first wedge-receiving cavity from said first side of said anchor body, the system further comprising:

a first cap removably affixed to said cap-receiving receptacle, said first tendon having an end positioned interior of said first cap.

7. The system of claim 5, said polymeric encapsulation defining a second cap-receiving receptacle extending outwardly from said second wedge-receiving cavity from said fsecond side of said anchor body, the system further comprising:

a second cap removably affixed to said second cap-receiving receptacle, said second tendon having an end positioned interior of said second cap.

8. A method of post-tensioning an intermediate anchorage in a post-tension system comprising:

forming a dead-end anchorage having a first tendon affixed thereto;

forming an anchor body having a first cavity and a second cavity in which the first cavity narrows in diameter from a first side to a second side of said anchor body, said second cavity narrowing in diameter from said second side to said first side of said anchor body, anchor also comprising a polymeric encapsulation in liquid-tight sealing relationship with an exterior surface of said anchor body, said polymeric encapsulation defining a first cap-receiving receptacle extending outwardly of said first cavity from said first side of said anchor body, said polymeric encapsulation defining a second cap-receiving receptacle extending outwardly of said second cavity from said second side of said anchor body;

affixing an end of a second tendon within said second cavity such that said second tendon extends outwardly from said first side of said anchor body;

positioning said dead-end anchorage and said anchor body within a form;

installing an end of said first tendon within said first cavity of said anchor body;

solidifying concrete around said dead-end anchorage and said anchor body within said form; and tensioning said first tendon from said first side of said anchor body; and affixing said first tendon in a tensioned state within said first cavity.

9. The method of claim 8, further comprising:

positioning a live end anchorage within another form, said live end anchorage having a cavity formed therein;

extending said second tendon through said another form so that an end of said second tendon is received within said cavity of said live end anchorage;

solidifying concrete around said second tendon and said live end anchorage within said another form;

tensioning an end of said second tendon at said live end anchorage; and affixing said second tendon in a tensioned state within said cavity of said live end anchorage.

10. The method of claim 8, further comprising:

encapsulating said anchor body such that the end of said first tendon and the end of said second tendon are in liquid-tight sealing relationship within said anchor body.

11. The method of claim 8, said first tendon being affixed to said dead-end anchorage and said second tendon being affixed to said anchor body prior to said step of positioning within said form.

* * * * *